US006227159B1

(12) United States Patent
Ropertz

(10) Patent No.: US 6,227,159 B1
(45) Date of Patent: May 8, 2001

(54) AIR PIPE LINE DISTRIBUTION SYSTEM

(75) Inventor: Peter Ropertz, Markgroningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/117,845

(22) PCT Filed: Sep. 24, 1997

(86) PCT No.: PCT/DE97/02162

§ 371 Date: Apr. 9, 1999

§ 102(e) Date: Apr. 9, 1999

(87) PCT Pub. No.: WO98/25022

PCT Pub. Date: Jun. 11, 1998

(30) Foreign Application Priority Data

Dec. 6, 1996 (DE) ..... 196 50 806

(51) Int. Cl.[7] ..... F02M 31/00
(52) U.S. Cl. ..... 123/184.21; 123/184.22
(58) Field of Search ..... 123/184.21, 184.22, 123/184.42

(56) References Cited

U.S. PATENT DOCUMENTS

| | | | | |
|---|---|---|---|---|
| 3,747,303 | * | 7/1973 | Jordan | 55/318 |
| 4,183,332 | * | 1/1980 | Hofbauer et al. | 123/184.42 |
| 4,440,555 | * | 4/1984 | Chichester | 123/195 C |
| 4,932,490 | * | 6/1990 | Dewey | 180/68.3 |
| 5,575,247 | * | 11/1996 | Nakayama et al. | 123/184.21 |
| 5,769,045 | * | 6/1998 | Edwards et al. | 123/184.61 |
| 5,950,586 | * | 9/1999 | Ropertz | 123/184.42 |

* cited by examiner

*Primary Examiner*—Marguerite McMahon
*Assistant Examiner*—Jason Benton
(74) *Attorney, Agent, or Firm*—Ronald E. Greigg; Edwin E. Greigg

(57) ABSTRACT

The invention relates to a refinement of an air guiding system for an internal combustion engine, having an intake conduit which adjoins an air inlet opening downstream and is part of a gas guiding chamber that carries air from the air inlet opening to an outlet opening. In the air guiding system, an air filter is embodied as an interchangeable cartridge in such a way that the air filter is insertable into and removed from the intake conduit.

19 Claims, 5 Drawing Sheets

AIR PIPE LINE DISTRIBUTION SYSTEM

The invention is based on an air guiding system for an internal combustion engine.

The air guiding system is intended for an internal combustion engine of a motor vehicle. One such air guiding system is known from German Patent 38 42 248, for example. The known air guiding system has an air inlet opening, an intake conduit adjoining the air inlet opening downstream, and an outlet opening connected to a gas inlet opening of the combustion chamber of an internal combustion engine. The outlet opening is located downstream of an outlet conduit. The intake conduit and the outlet conduit are embodied as a diffusor, in order to provide noise abatement. Downstream of the intake conduit or upstream of the outlet conduit, there is a deflection chamber that deflects the gas stream by 180° from the intake conduit into the outlet conduit. Also located at the inlet to the outlet conduit is an air filter for filtering the air, flowing through the air guiding system, for the engine; the air filter is accessible only by removing the housing of the deflection chamber.

A disadvantage of the known air guiding system is that the air filter is relatively poorly accessible, and installing and removing the air filter entails relatively major assembly effort and expense. Moreover, the air filter has a relatively small usable filter area, so that the air stream in the air guiding system is exposed to a relatively high flow resistance in the region of the filter. Another disadvantage of the known air guiding system is that it requires a relatively large amount of space in the engine compartment of the motor vehicle, and a relatively large installation space must therefore be made available for the air guiding system.

ADVANTAGES OF THE INVENTION

The air guiding system according to the invention has the advantage over the prior art that the air filter can be installed in the air guiding system without a major assembly effort and expense and if maintenance is needed can be replaced relatively simply. The intake conduit acts simultaneously as a housing for the air filter, so that the hollow space in the intake conduit is utilized as a filter chamber. A high packing density of the components in the intake region of the air guiding system is thereby attained, and the installation space required for the air guiding system is reduced further. Overall, an extremely compact design of the air guiding system is attained, and at the same time the volumetric region through which unfiltered crude air flows is reduced to a minimum.

The intake conduit may be closable with a cap on the side toward the air inlet opening, so that once the cap is removed the air filter can be replaced with only a few manual operations.

The air filter is preferably embodied as a component which is oriented axially to the longitudinal axis of the intake conduit and which devides an axial inner chamber from a peripheral outer chamber. Because of the axial alignment of the air filter, an especially large filter area is achieved, and as a result the flow resistance exerted by the air filter is advantageously reduced. An especially compact and at the same time dimensionally stable component is obtained if the air filter is embodied in the form of a hollow cylinder.

For an air guiding system with a gas guiding chamber which has one wormlike curved region and one region ducted through the wormlike curved region, an especially space-saving overall arrangement is obtained if the intake conduit that receives the air filter is integrated with the ducted region. In this way, the volume already present inside the wormlike curved region is utilized in an optimally space-saving way. A throttle device may also be integrated into the air guiding system without a major effort or expense.

BRIEF DESCRIPTION OF THE DRAWINGS

Preferably selected and especially advantageous exemplary embodiments of the invention are shown in the drawing in simplified form and described in further detail in the ensuing description. Shown are.

DESCRIPTION OF THE EXEMPLARY EMBODIMENTS

The air guiding system embodied according to the invention may be provided in various internal combustion engines. The engine is for instance a motor to which air or a fuel-air mixture is delivered via the air guiding system. The air guiding system can be structurally combined with various components required for operating the engine.

The engine is for instance an aspirating engine, in which air is aspirated as a result of a suitable motion of the pistons. However, it is also possible in addition to provide a unit that delivers the air to the engine under pressure.

The engine preferably has a plurality of cylinders, but in principle it may also be an internal combustion engine with a single cylinder.

Although the engine may be of various types and can be used to drive various machines, for the sake of simplicity in the ensuing description of the exemplary embodiments it will be assumed that the engine operates on the principle of an Otto engine, is an aspirating engine, is installed in the engine compartment of a motor vehicle, and serves to drive the motor vehicle. It will also be assumed that the engine has four inline cylinders, with the line of the four cylinders being installed crosswise to the travel direction of the motor vehicle.

Figure 1:
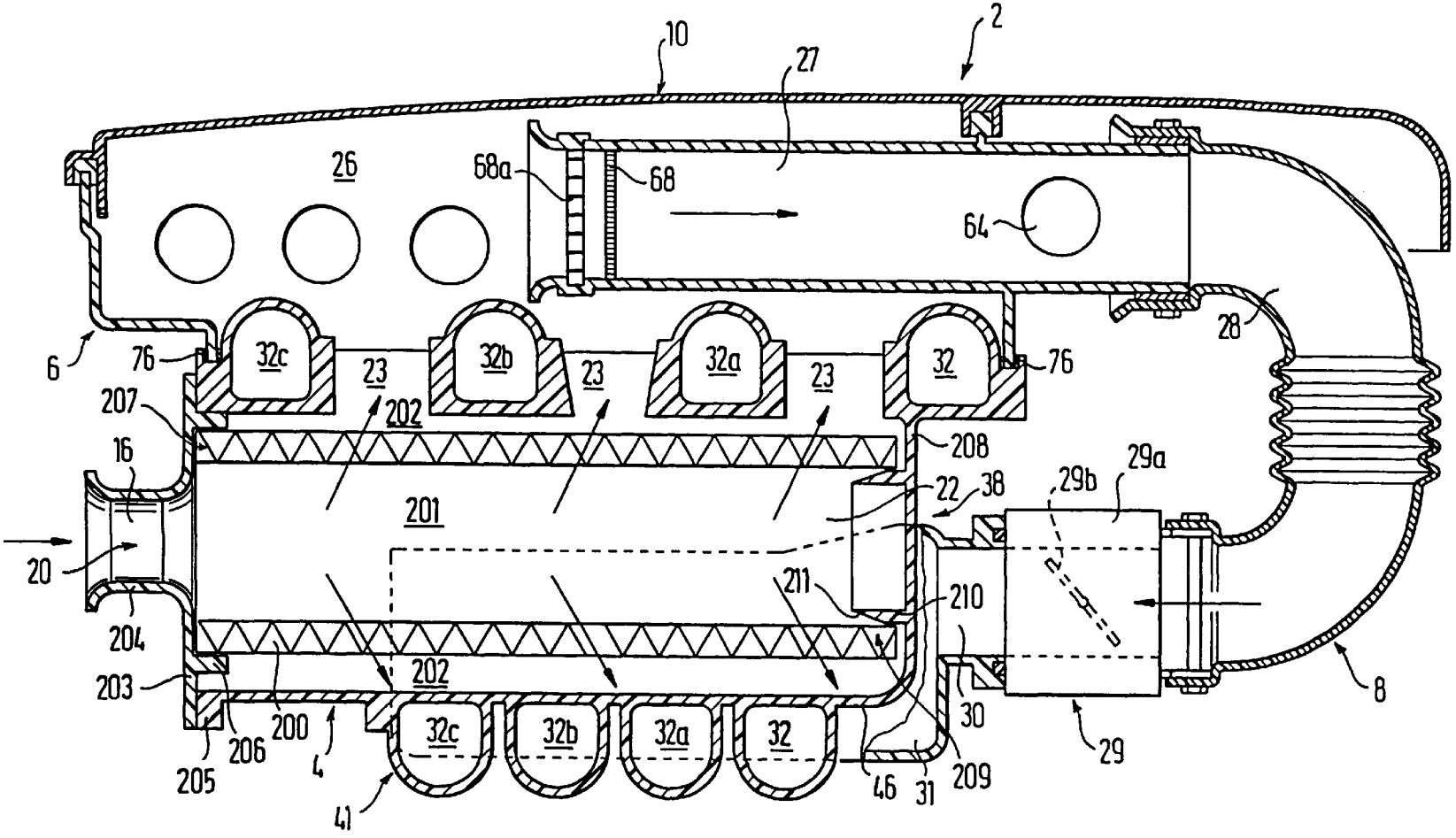
FIG. 1, a longitudinal section through an exemplary embodiment of the air guiding system.

FIG. 1 shows a longitudinal section through an air guiding system of the invention. The sectional plane shown extends crosswise to the travel direction of the motor vehicle.

Figure 2:
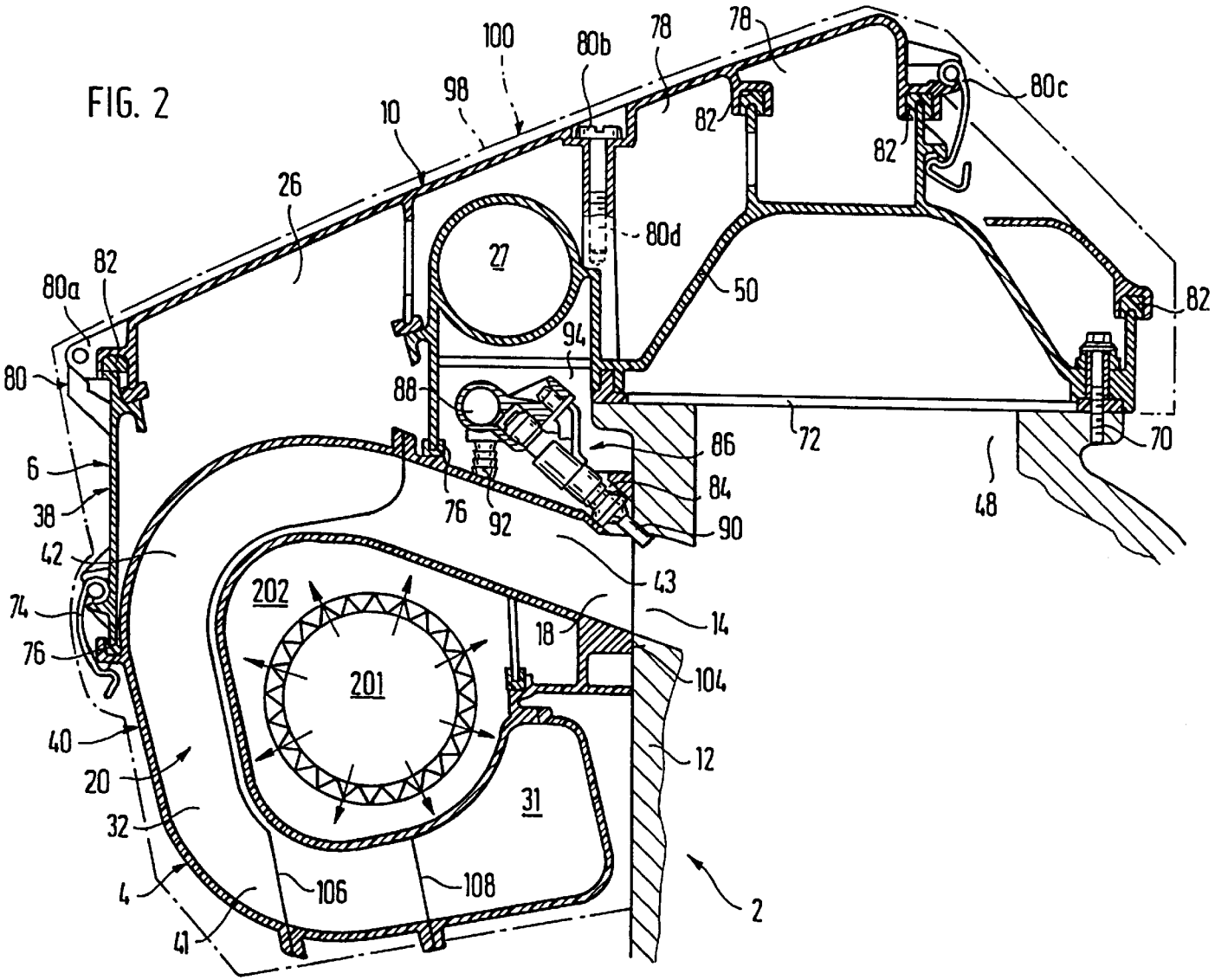
FIG. 2, a cross section through an exemplary embodiment of the air guiding system that has essentially the same structure as FIG. 1.

FIG. 2 shows a cross section longitudinally of the motor vehicle travel direction through an air guiding system, which is substantially structurally identical to the air guiding system shown in FIG. 1.

For the sake of greater simplicity, the sectional faces shown in FIGS. 1 and 2 are not each in a single plane but rather extend with multiple graduations, to make the most essential features of the invention as clearly apparent as possible.

Figure 3:
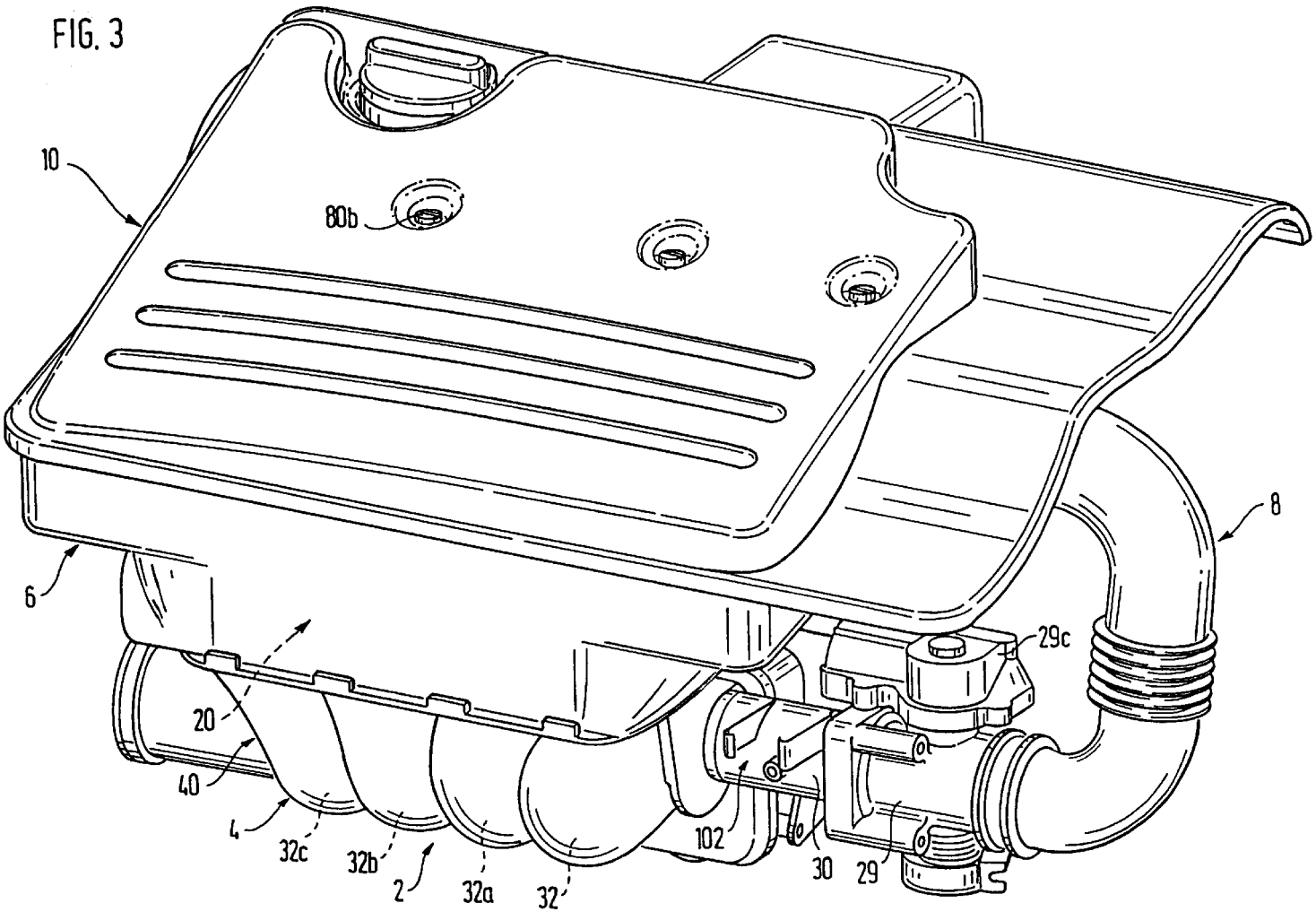
FIG. 3, a perspective view of an air guiding system corresponding to the exemplary embodiment shown in FIG. 2.

FIG. 3 is a view on the air guiding system of FIG. 2, looking obliquely toward the front from somewhat above the air guiding system.

In all the drawing figures, identical or identically functioning parts are identified by the same reference numerals. Unless anything to the contrary is mentioned or shown in the drawing, what is said and shown for one of the drawings applies to all the exemplary embodiments. Unless otherwise noted in the explanations, the details of the various exemplary embodiments can be combined with one another. The air guiding system 2 embodied in exemplary fashion and preferably selected for the description and drawing is composed essentially of a first air guiding part 4, a second air guiding part 6, a tube 8, and a design hood 10. In approximate terms, the first air guiding part 4, the second air guiding part 6, the tube 8 and the design hood 10 are the main components of the air guiding system 2.

In the ensuing description, the drawing figure is given in parentheses that shows that particular detail especially clearly.

The internal combustion engine selected has four cylinders and has a cylinder head 12. Of the engine, a small portion of a section through the cylinder head 12 is shown (FIG. 2). For the sake of simplicity, essentially only the outlines of the section through the cylinder head 12 are shown.

The cylinder head 12 belongs to an engine having at least one cylinder. Located in the cylinder are a displaceably supported piston (not shown, for the sake of simplicity), and a combustion chamber (also not shown, for the sake of simplicity). A gas inlet opening 14 leads into the combustion chamber of the engine. Through the gas inlet opening 14, air or a fuel-air mixture can reach the combustion chamber.

The air guiding system 2 has an air inlet opening 16 (FIGS. 1, 2) and an outlet opening 18 (FIG. 2). A gas guiding tube leads through the air guiding system 2. The gas guiding tube will hereinafter be called the gas guiding chamber 20. The gas guiding chamber 20 begins at the air inlet opening 16 and leads via the outlet opening 18 into the gas inlet opening 14 of the cylinder head 12 of the engine.

Through the gas guiding chamber 20, air can flow in through the air inlet opening 16 and reach the combustion chamber of the engine. In the course of the air guiding system 2, air flowing through it can have fuel or a mixture added to it, depending on the type of engine and as needed.

To simplify the explanations of the exemplary embodiments, the gas guiding chamber 20 will be thought of as being divided into a plurality of parts. In accordance with this imaginary division, the gas guiding chamber 20 includes first an air inlet opening 16, which is adjoined downstream by an intake conduit 22 (FIGS. 1, 2). The intake conduit 22 serves at the same time as the filter installation space and receives an air filter 200, which will be described in further detail hereinafter. The intake conduit 22 is followed in the flow direction by three connecting conduits 23 (FIG. 1). In a post-filter chamber 26, the connecting conduits 23 come together again. Downstream of the post-filter chamber 26 is a calming conduit 27 (FIGS. 1, 2). The calming conduit 27 is followed by a connecting conduit 28 (FIG. 1). The connecting conduit 28 is located substantially inside the flexible tube 8. The connecting conduit 28 ends downstream in a throttle device 29 (FIGS. 1, 3). This is followed downstream by a connecting stub 30 (FIGS. 1, 3). The connecting stub 30 discharges into a gas distribution chamber 31 (FIGS. 1, 2). From the gas distribution chamber 31, a conduit 32 branches off (FIGS. 1, 2, 3). The conduit 32 carries the medium flowing through the air guiding system 2, or some of this medium, out of the gas distribution chamber 31 through the outlet opening 18 and through the gas inlet opening 14 into the combustion chamber of the engine. Because the preferably selected air guiding system 2 is provided as an example for an internal combustion engine with four combustion chambers, three further conduits 32*a*, 32*b*, 32*c* (FIGS. 1, 3) branch off from the gas distribution chamber 31, parallel to the conduit 32; each of the conduits 32, 32*a*, 32*b*, 32*c* leads to a respective combustion chamber of the four-cylinder engine.

The intake conduit 22 and in part the connecting conduits 23 belong to a region of the air guiding system 2 that will hereinafter be called the ducted region 38.

The conduits 32, 32*a*, 32*b*, 32*c*, in terms of the longitudinal direction of the gas distribution chamber 31, branch off from the gas distribution chamber 31 virtually vertically. The conduits 32, 32*a*, 32*b*, 32*c* form a wormlike curved region 40 (FIG. 2) of the air guiding system 2. In approximate terms, the curved region 40 can be imagined as being divided into a first portion 41, a second portion 42, and a third portion 43.

The first portion 41, in terms of the flow direction, begins at the branching point of the conduits 32, 32*a*, 32*b*, 32*c* from the gas distribution chamber 31. In the first portion 41, the conduits 32, 32*a*, 32*b*, 32*c* communicate with one another via a wall 46 (FIG. 1). The first portion 41 of the conduits 32, 32*a*, 32*b*, 32*c* (FIG. 1) is located on the outward-facing side of the wall 46, and the intake conduit 22 is located on the inward-facing side of the wall 46. The wall 46 partitions the intake conduit 22 off from the environment, and the wall 46 also serves to partition off the conduits 32, 32*a*, 32*b*, 32*c* from the intake conduit 22. In the first portion 41, the conduits 32, 32*a*, 32*b*, 32*c* extend in an arc (a wide-angled arc of approximately 90° in the viewing direction of FIG. 2). The arc is followed by a short straight piece. The end of the first portion 41 is placed in imaginary terms against the end of the straight piece.

The second portion 42 of the curved region 40 adjoins the first portion 41. In the second portion 42, the conduits 32, 32*a*, 32*b*, 32*c* are extended in a further arc (right-angled curve of approximately 120°, for instance, in the viewing direction of FIG. 2). In the second portion 42, the conduits 32, 32*a*, 32*b*, 32*c* are spaced apart from one another such that gaps ensue between the conduits 32, 32*a*, 32*b*, 32*c*, which gaps serve the connecting conduits 23 for connecting the intake conduit 22 to the post-filter chamber 26 (FIG. 1). The air from the intake conduit 22 can flow in the direction of the post-filter chamber 26 through the gaps between the spaced-apart conduits 32, 32*a*, 32*b*, 32*c*.

The second portion 42 is adjoined by the third portion 43 (FIG. 2). In the third portion 43, the conduits 32, 32*a*, 32*b*, 32*c* are then substantially straight, until each of the conduits 32, 32*a*, 32*b*, 32*c* ends at a respective outlet opening 18. The conduits 32, 32*a*, 32*b*, 32*c* are curved in wormlike fashion. In the three portions 41, 42, 43, the conduits 32, 32*a*, 32*b*, 32*c* are curved by a total of 180°, for instance. As FIG. 1 shows, the conduits 32, 32*a*, 32*b*, 32*c* may in particular also be curved by more than 180°. The so-called wormlike curved region 40 at least partially encloses the ducted region 38.

At the cylinder head 12 of the engine, there is a chamber 48 (FIG. 2). Located in the chamber 48 are for instance the usual inlet valves, outlet valves, and the control shaft for controlling the inlet and outlet valves, that are usual in an internal combustion engine. The control shaft and inlet and outlet valves are not shown, for the sake of greater simplicity. The chamber 48 (FIG. 2) is covered with the aid of a cylinder head hood 50 (FIG. 2).

The cylinder head hood 50 is shaped such that it serves both to cover the chamber 48 of the cylinder head 12 and to form the second air guiding part 6 of the air guiding system 2. In other words, the second air guiding part 6 is shaped such that it both is a component of the air guiding system 2 and acts to cover the chamber 48 of the engine. The second air guiding part 6 with the cylinder head hood 50 formed onto it can be made in an integrally cohesive way from an injection mold. The material of the second air guiding part 6 is preferably plastic.

The post-filter chamber 26 is sealed off from the design hood 10 by an encompassing seal 58 (FIGS. 1, 2).

A connection opening 64 (FIG. 1) is formed onto the second air guiding part 6. The connection opening 64 discharges into the calming conduit 27. A flow rate meter may be provided in the connection opening 64. The flow rate meter can sense the volume flowing per unit of time through the gas guiding chamber 20 or the mass of air flowing per unit of time through the gas guiding chamber 20 and furnish an electrical signal accordingly to an electronic system, not shown. Along with or instead of the flow rate meter, a thermometer that measures the temperature of the air flowing through may also be installed in the connection opening 64.

Upstream of the flow rate meter 66, a screen 68 (FIG. 1) made of metal and/or a flow lattice 68 molded from plastic are provided in the calming conduit 27. The screen 68 and the flow lattice 68*a* promote the calming of the air flowing to the flow rate meter.

The second air guiding part 6 of the air guiding system 2, which also takes on the function of the cylinder head hood 50, is connected to the cylinder head 12 of the engine via a fastening means 70 (FIG. 2), or a plurality of fastening means 70. The fastening means 70 is in the form of a screw or a plurality of screws, for instance, with which the air guiding part 6 is solidly connected to the engine. Between the cylinder head 12 and the air guiding part 6, an encompassing cylinder head seal 72 (FIG. 2) is provided, which seals off the chamber 48 from the environment.

The second air guiding part 6 is connected solidly, but separably as needed, to the first air guiding part 4 via a fastening means 74 (FIG. 2). The fastening means 74 for instance includes a clamp or a plurality of clamps distributed over the circumference. The clamps of the fastening means 74 are pivotably supported on the second air guide part 6, for instance, and once the second air guide part 6 is mounted on the first air guiding part 4, these clamps can be snapped into place on corresponding cams provided on the first air guiding part 4. Between the first air guiding part 4 and the second air guiding part 6, a housing seal 76 is provided (FIGS. 1, 2). The housing seal 76 seals off the gas guiding chamber 20 from the environment.

The design hood 10 is mounted on the second air guiding part 6. The shapes of the design hood 10 and the second air guiding part 6 are adapted to one another such that a hollow chamber, which a component of the post-filter chamber 26, forms between the design hood 10 and the second air guiding part 6. The hollow chamber between the design hood 10 and the second air guiding part 6 extends not only in the region immediately downstream of the conduits 32, 32*a*, 32*b*, 32*c*, but this hollow chamber also extends far into the region located above the cylinder hood 50 that covers the chamber 48. As a result, an additional chamber 78 (FIG. 2) is created between the design hood 10 and the second air guiding part 6. The chamber 76 is located not directly in the air flow but rather somewhat aside from it. Intermediate ribs are provided between the design hood 10 and the air guiding part 6 for reinforcement purposes. There are openings in the intermediate ribs, so that the additional chamber 78 communicates directly with the gas guiding chamber 20. The additional chamber 78 increases the usable volume of the gas guiding chamber 20. This has considerable effects on the noise produced by the engine. Because the gas guiding chamber 20 can be designed as rather large even when external space conditions are restricted, the noise produced by the air guiding system 2 or the engine can be reduced substantially.

The design hood 10 is solidly, but if needed separably, connected to the second air guiding part 6 via a fastening means 80 (FIG. 2). The fastening means 80 for instance includes a hinge 80*a* or a plurality of hinges 80*a*, a screw 80*b* or a plurality of screws 80*b*, and a clamp 80*c* or a plurality of clamps 80*c*. Depending on the number of screws 80*b*, the fastening means also includes a nut thread 80*d* (FIG. 2) or a plurality of nut threads 80*d*, formed onto the air guiding part 6 or cut onto it, for screwing in the screw 80*b* or screws 80*b* for fastening the design hood 10 to the air guiding part 6. After the clamp 80*c* and the screw 80*b* have been loosened, the design hood 10 can be pivoted relative to the air guiding part 6.

At points of contact between the design hood 10 and the second air guiding part 6, an encompassing seal 82 is provided. The seal 82 is also mounted on the intermediate ribs between the air guiding part 6 and the design hood 10.

The cylinder head seal 72, the housing seal 76 between the two air guiding parts 4 and 6, and the seal 82 all serve to provide sealing and acoustical decoupling among the various structural parts and thus have a noise-abating effect.

In the air guiding system 2, a fuel delivery opening 84 (FIG. 2) is provided. As the preferably selected exemplary embodiment shows, the fuel delivery opening 84 leads into the gas guiding chamber 20 in the region of the outlet opening 18. Depending on the number of conduits 32, 32*a*, 32*b*, 32*c*, a corresponding number of fuel delivery openings 84 is provided.

A fuel distributor strip 86 (FIG. 2) is mounted on the air guiding system 2. The fuel distributor strip 86 includes a fuel tube 88, an electromagnetically actuatable injection valve 90 (FIG. 2), and a fuel stub 92. One injection valve 90 is inserted into each of the fuel delivery openings. Each of these four injection valves 90 branches off from the fuel tube 88. For the sake of simplicity, only one of the injection valves 90 is shown in FIG. 2. Via a fuel pump, not shown, the fuel flows via the fuel stub 92 into the fuel tube 88. Between the first air guiding part 4 and the second air guiding part 6, a hollow chamber 94 is formed, extending along the cylinders, for instance four in number, of the engine. The fuel distributor strip 86 having the injection valves 90 can be disposed in this hollow chamber 94.

In FIG. 2, a dot-dashed line 98 that is bent several times at an angle is shown. The dot-dashed line 98 on the one hand and the cylinder head 12 of the engine on the other define an installation space 100. Another reason is because the air guiding system 2 has both the wormlike curved region 40 and the ducted region 38 that is ducted at least partly through the inside of the wormlike curved region 40 and that substantially includes the intake conduit 22, the particularly good utilization of the available installation space 100 is achieved.

The tube 8 is connected by its upstream end to the calming conduit 27 (FIG. 1) formed onto the air guiding part 6, and downstream the tube 8 is connected to the throttle device 29.

The throttle device 29 is mechanically coupled to the first air guiding part 4. Via the elastic housing seal 76, the two air guiding parts 4 and 6 are largely decoupled in terms of vibration and acoustically. The tube 8 is elastic and therefore does not hinder the vibrational decoupling between the two air guiding parts 4 and 6, or hinders it only insignificantly. The throttle device 29 for includes a throttle valve 29*b* (FIG. 1) pivotably supported in a throttle valve stub 29*a*. The position of the throttle valve 29*b* is variable, for instance with the aid of an electrically controllable actuator 29*c* (FIG. 3). The throttle device 29, which includes the throttle valve stub 29*a*, the throttle valve 29*b*, and the actuator 29*c*, can be flanged as a complete unit to the first air guiding part 4 of the air guiding system 2.

A retaining device 102 (FIG. 3) is provided on the preferred example of an air guiding system 2 shown. Via the retaining device 102, a tank venting valve can for instance be secured to the air guiding system 2. The retaining device 102 is formed onto the connecting stub 30 of the first air guiding part 4, for instance. When assembled, the air guiding system 2 forms a functional unit for an internal combustion engine and can therefore also be called an air guiding module.

A flange face 102 (FIG. 2) is provided on the first air guiding part 4. There is a counterpart flange face on the engine. The first air guiding part 4 can be secured to the counterpart flange face of the engine by the flange face 104. Fastening means, especially screws, not shown in the drawing are used for this purpose.

In the exemplary embodiment shown, the four injection valves 90 are provided in order to meter fuel separately to each cylinder of the engine. It should be pointed out that the air guiding system 2 may also be embodied such that fuel is delivered at some other point of the air guiding system 2. For instance, it is possible to inject fuel into the gas-guiding chamber 20 in the region of the throttle device 29, in which case the fuel mixes intensively with the air in the region of the throttle device 29 and is delivered together with the air to the combustion chambers of the engine. The possibility also exists of injecting the fuel, via injection valves, not shown, not into the air guiding system 2 but rather directly into the combustion chambers of the engine.

In the first air guiding part 4, there is a curved first dividing plane 106 and a curved second dividing plane 108 (FIG. 2). For the sake of easy production of the air guiding part 4 using casting techniques, the air guiding part 4 is made from three cast or injection-molded individual parts, which are welded together or adhesively bonded to one another after the casting or injection molding. Because both the first air guiding part 4 and the second air guiding part 6 are preferably of plastic, it is easily possible to weld or adhesively bond the three individual parts to one another.

According to the invention, the air filter 200 is embodied as an interchangeable cartridge and is insertable directly into the intake conduit 22 of the air guiding system 2 that adjoins the air inlet opening 16. The cartridge-like embodiment of the air filter 200 allows easy, fast replacement. The disposition of the air filter 200 in the intake conduit 22 immediately downstream of the air inlet opening 16 has the advantage that the air is already filtered in the inlet region of the air guiding system 2, and the crude air chamber of the air guiding system 2 that contains unfiltered air is reduced to a region of minimal volume. This accordingly prevents soiling of the air guiding system 2 even under extreme conditions of use. In the exemplary embodiment shown in FIGS. 1 and 2, the air filter 200 is embodied hollow-cylindrically. The air filter 200 radially surrounds an inner chamber 201, which extends in the axial direction of the intake conduit 22 in the interior of the air filter 200; the air filter 200 divides a peripheral outer chamber 202 from the inner chamber 201 (FIGS. 1, 2).

For replacement of the air filter 200, the intake conduit 22 has a cap 203 (FIG. 1), which in the exemplary embodiment includes an intake stub 204 in which the air inlet opening 16 is embodied. The cap 203 is joined to a flange 205 of the intake conduit 22, for instance by screwing (FIG. 1), and is sealed off from the flange 205, for instance by the placement of an O-ring or some other suitable sealing means. The cap 203 at the same time serves as a retainer for the air filter 200 inserted into the intake conduit 22. To that end, the cap 203 has suitable retaining devices, for instance in the form of a preferably radially encompassing protrusion 206. In the exemplary embodiment shown, the air filter 200, on its end 207 toward the cap 206, is locked on the outside on this protrusion 206, because the protrusion 206 encloses the air filter 200 on the outside. The wall 208 of the intake conduit 22 opposite the cap 203 has a corresponding retaining device, for locking the air filter 200 on its end 209 opposite the cap 203. In the exemplary embodiment, this retaining device is embodied as a radially encompassing protrusion 210, which on the inside encloses the air filter 200 on its end 209 opposite the cap 203 (FIG. 1).

For replacement of the air filter 200 embodied as an interchangeable cartridge, the cap 203 need merely be removed, and after that the air filter is freely accessible and can be grasped. Upon insertion of the air filter 200, the air filter is introduced into the intake conduit 22 and slipped onto the protrusion 210. The cap 203 is then placed on the flange 205, so that the air filter 200 is at the same time inserted into the radial inner region of the protrusion 206. Alternatively, the procedure may also be such that the air filter 200 is first inserted into the radial inner region of the protrusion 206 of the cap 203 and that the air filter 200 is clamped together with the cap 203 in this way. The air filter 200 is then introduced into the intake conduit 22 far enough that the cap 203 rests on the flange 205, and at the same time the end 209 of the air filter 200 opposite the cap 203 is engaged by the protrusion 210. The guidance of the air filter 200 in the intake conduit 22 can be facilitated by providing that the protrusions 210 have conical regions 211, which center the air filter 200 (FIG. 1).

The crude air region of the air guiding system 2 embodied according to the invention includes only the air inlet opening 16 and the inner chamber 201 of the air filter 200. Any dirt particles that may be aspirated are retained by the air filter 200 and either remain stuck to the filter material, or if the aspirated air is heavily soiled, they collect in the inner chamber 201. When the air filter 200 embodied as an interchangeable cartridge is replaced, the dirt particles that might have collected in the inner chamber 201 are therefore also removed from the intake conduit 22 along with the air filter 200, so that contamination of the air guiding system 2 when the air filter 200 is being replaced is effectively avoided. Moreover, the volume of the crude air region is reduced to a minimum, so that the air guiding system 2 does not become soiled at any point and can therefore be operated without maintenance even under extreme conditions of use. Because of the integration of the air filter 200 with the intake conduit 22, or the functional expansion of the intake conduit 22 as a filter housing for the air filter 200, the degree of integration of the air guiding system 2 is increased further, and an especially compact design with optimal utilization of the available installation space 100 is achieved. The exemplary embodiment shown in FIG. 1 is also distinguished in that the intake conduit 22 together with the air filter 200 is disposed in the region 38 that is ducted through the conduits 32, 32*a*, 32*b*, 32*c* of the wormlike curved region 40. This makes an especially space-saving, compact design of the air guiding system 2 possible.

For the sake of better comprehension of the invention, the air flow in the air guiding system 2 is represented by arrows in FIGS. 1 and 2. This makes it clear that the crude air first flows via the air inlet opening 16 to the inner chamber 201 and then flows, with a radially outward-oriented flow component, through the air filter 200 into the peripheral outer chamber 202.

Figure 4:
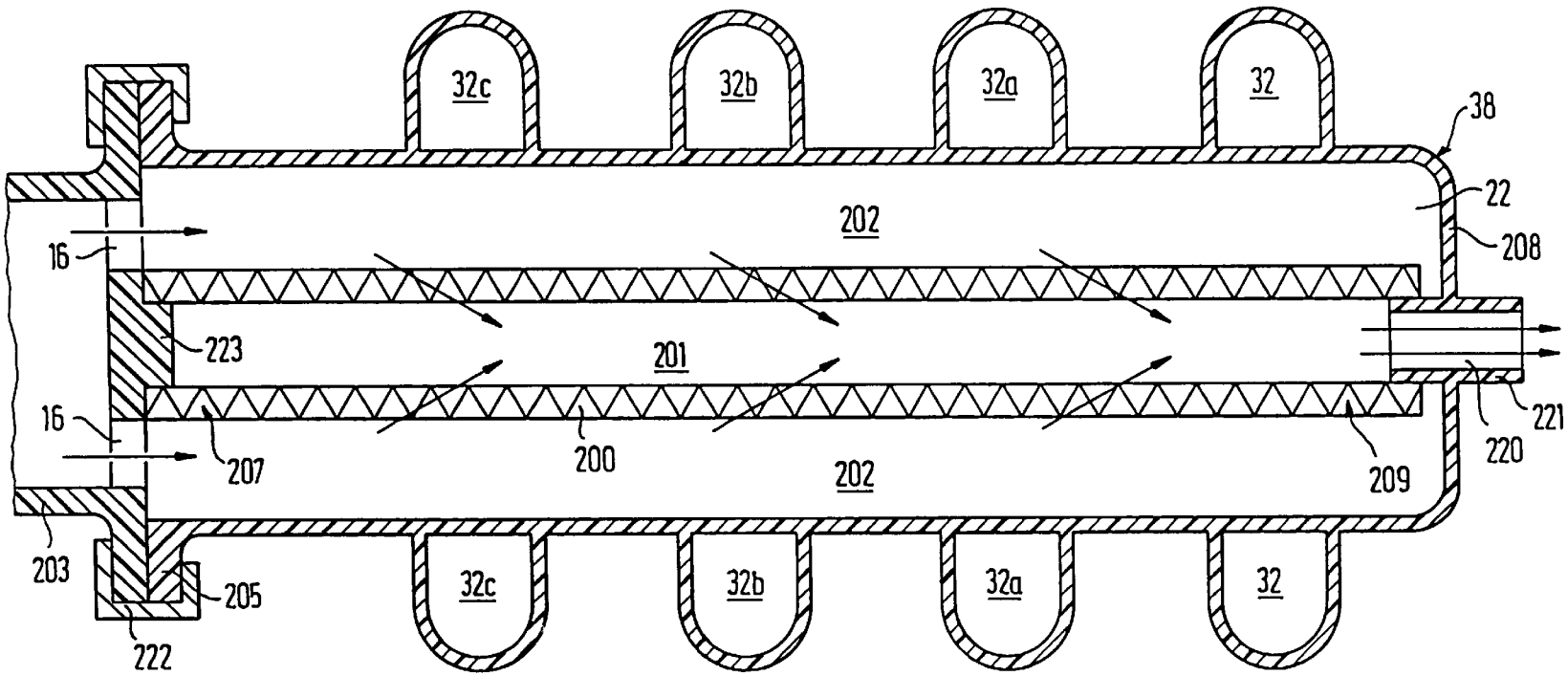
FIG. 4, a longitudinal section through the intake conduit of a further exemplary embodiment of an air guiding system.

FIG. 4 shows a further exemplary embodiment of the invention in the form of a basic sketch. In contrast to the exemplary embodiment described above, in the exemplary embodiment shown in FIG. 4 the air flow is carried such that the air flows from the peripheral outer chamber 202 with a radially inward-oriented flow component through the air filter 200 into the axial inner chamber 201. The radial flow direction through the air filter 200 is accordingly the reverse of the exemplary embodiment described earlier above.

In order to achieve this flow course, the air inlet opening 16 is disposed on the outside in the cap 203, so that the aspirated air first flows into the peripheral outer chamber 202. After flowing through the air filter 200, the cleaned air is carried away from the axial inner chamber 201 via an intake conduit outlet opening 220 located on the end 209 of the air filter 200 opposite the cap 203. To that end, the well 208 of the intake conduit 22 has a tubular outlet stub 221, in which the intake conduit of 220 is embodied. The airflow is clearly shown by corresponding arrows in FIG. 4. The cap 203 can be joined to the flange 205 by fast-release clamping elements, for instance by means of merely schematically shown closure clamps 222. The outlet stub 221 at the same time acts as a retaining device for the end 209 of the air filter 200 opposite the cap 203. As a retaining device for the end 207 of the air filter 200 toward the cap 203, the cap 203 has a protrusion 223. In this way, the air filter 200 is locked centrally in the intake conduit 22.

Figure 5:
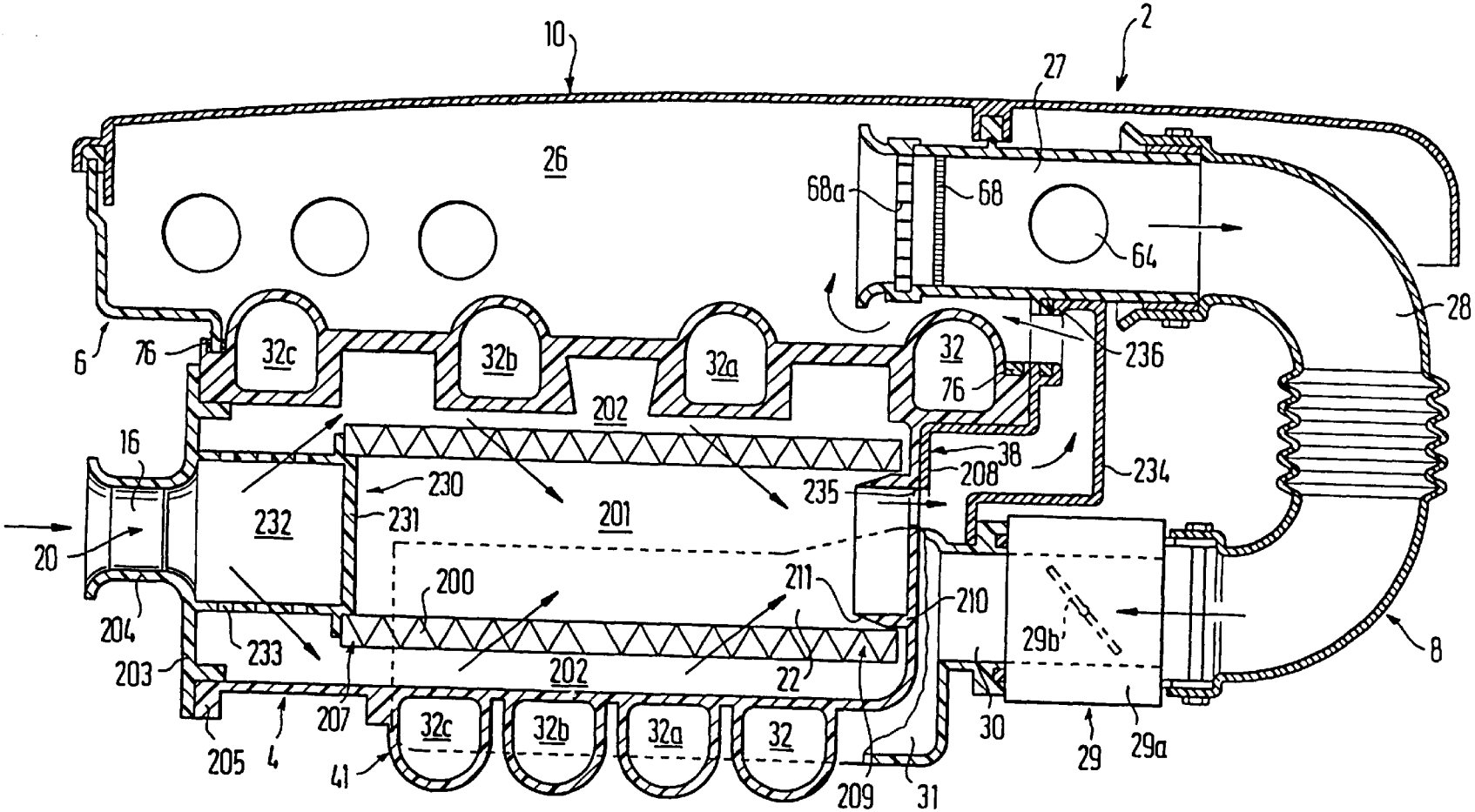
FIG. 5, a longitudinal section through an air guiding system corresponding to a further exemplary embodiment.

FIG. 5 shows a realization of the exemplary embodiment shown only schematically in FIG. 4, here in the case of an air guiding system 2 that has substantially the same basic design as the exemplary embodiment shown in FIG. 1. A cup-shaped filter retainer 230 is formed onto the inside of the cap 230. The filter retainer 230 locks the air filter 200 on its end 207 toward the cap 203. The filter retainer 230 also has a termination plate 231, which seals off the interior 201 of the air filter 200 from a prefilter chamber 232 following the air inlet opening 16. The cup-shaped filter retainer 230 also has through openings 233, in order to make the prefilter chamber 232, communicating with the air inlet opening 16, communicate with the peripheral outer chamber 202 of the air filter 200. The aspirated crude air then flows first via the air inlet opening 16 into the prefilter chamber 232 and then through the through openings 233 into the peripheral outer chamber 202 of the air filter 200. The air then flows through the air filter 200 with a radially inward-oriented flow component, as has already been explained in conjunction with FIG. 4. The filtered air flows via an elbow 234, which communicates via a communication opening 235 with the axial inner chamber 201, into the post-filter chamber 26. The further course of the air flow is equivalent to the flow course already explained in conjunction with FIG. 1. The elbow 234 is sealed off from the second air guiding part 6 via the housing seal 76 and an additional seal 236.

Manifold embodiments of the air filter 200 and the associated retaining devices within the intake conduit 22 are conceivable within the scope of the invention. The air filter 200 need not necessarily be hollow-cylindrical at all. For instance, it is readily conceivable to embody the air filter 200 with a rectangular cross section, and in particular a square cross section. The air filter 200 can also be completely closed on one of its two face ends, in the form of a pouchlike embodiment. It is also conceivable for a pouchlike air filter 200 to be disposed in the intake conduit 22 in such a way that the crude air flowing in via the air inlet opening 16 inflates the intake conduit 22 like a vacuum cleaner. It can then suffice merely to secure the air filter 200 sealingly in the cap 203, so that the pouchlike air filter 200 is removed from the intake conduit when the cap 203 is removed.

The foregoing relates to a preferred exemplary embodiment of the invention, it being understood that other variants and embodiments thereof are possible within the spirit and scope of the invention, the latter being defined by the appended claims.

What is claimed is:

1. An air guiding system for an internal combustion engine, which has at least one combustion chamber with at least one gas inlet opening leading into the combustion chamber, comprising an air inlet opening (16), an intake conduit (22) adjoining the air inlet opening (16) downstream, an outlet opening (18) connected to the gas inlet opening of the combustion chamber, a gas guiding chamber (20) that guides air from the air inlet opening (16) to the outlet opening (18), and an air filter (200) provided in the gas guide chamber (20), the air filter (200) is embodied as an interchangeable cartridge that can be inserted into and removed from the intake conduit (22), the gas guiding chamber (20) has a curved region (40) shaped in wormlike form, in which the wormlike curved region (40) is part of a wall of the intake conduit (22), and the intake conduit (22) receiving the air filter (200) is disposed in a ducted region (38), which is ducted through the wormlike curved region (40).

2. The air guiding system of claim 1, in which the intake conduit (22) is closable with a cap (203) containing the air inlet opening (16), in such a way that the air filter (200) is inserted into and removed from the intake conduit (22) when the cap (203) has been removed.

3. The air guiding system of claim 1, in which the air filter (200) surrounds an inner chamber (201) that is axial with regard to the longitudinal axis of the intake conduit (22) and divides the inner chamber (201) from a peripheral outer chamber (202).

4. The air guiding system of claim 3, in which the air flows via the air inlet opening (16) to the inner chamber (201) and flows with a radially outward-oriented flow component through the air filter (200) into the peripheral outer chamber (202).

5. The air guiding system of claim 3, in which the air flows via the air inlet opening (16) to the peripheral outer chamber (202) and flows with a radially outward-oriented flow component through the air filter (200) into the inner chamber (201).

6. The air guiding system of claim 3, in which the air filter (200) is embodied substantially in the form of a hollow cylinder.

7. The air guiding system of claim 4, in which the air filter (200) is embodied substantially in the form of a hollow cylinder.

8. The air guiding system of claim 5, in which the air filter (200) is embodied substantially in the form of a hollow cylinder.

9. The air guiding system of claim 1, in which retaining devices (210, 206; 210, 230) for receiving and orienting the air filter (200) are provided on the wall of the intake conduit (22).

10. The air guiding system of claim 2, in which retaining devices (210, 206; 210, 230) for receiving and orienting the air filter (200) are provided on the wall of the intake conduit (22).

11. The air guiding system of claim 3, in which retaining devices (210, 206; 210, 230) for receiving and orienting the air filter (200) are provided on the wall of the intake conduit (22).

12. The air guiding system of claim 2, in which one group of the retaining devices (206; 230) are provided on the cap (203), and another group of the retaining devices (210) are provided on the wall (208) of the intake conduit (22) opposite the cap (203), in order to lock the air filter (200) on each of its two respective ends (207, 209).

13. The air guiding system of claim 11, in which one group of the retaining devices (206; 230) are provided on the cap (203), and another group of the retaining devices (210) are provided on the wall (208) of the intake conduit (22) opposite the cap (203), in order to lock the air filter (200) on each of its two respective ends (207, 209).

14. The air guiding system of claim 1, in which a throttle device (29) is provided downstream of the air filter (200).

15. The air guiding system of claim 2, in which a throttle device (29) is provided downstream of the air filter (200).

16. The air guiding system of claim 3, in which a throttle device (29) is provided downstream of the air filter (200).

17. The air guiding system of claim 1, in which the wormlike curved region (40) is divided into a plurality of conduits (32, 32*a*, 32*b*, 32*c*), which each at least partially enclose the intake conduit (22).

18. The air guiding system of claim 14, in which the throttle device (29) is disposed between the air filter (200) and the wormlike curved region (40).

19. The air guiding system of claim 17, in which between the plurality of conduits (32, 32*a*, 32*b*, 32*c*) a wall is provided that closes off the intake conduit 22 from an outside.

* * * * *

UNITED STATES PATENT AND TRADEMARK OFFICE

CERTIFICATE OF CORRECTION

PATENT NO. : 6,227,159 B1
DATED : May 8, 2001
INVENTOR(S) : Peter Ropertz

It is certified that error appears in the above-identified patent and that said Letters Patent is hereby corrected as shown below:

Title page,
The Title should read as follows:
-- [54] AIR GUIDING SYSTEM FOR AN INTERNAL COMBUSTION SYSTEM --

Signed and Sealed this

Eighteenth Day of December, 2001

*Attest:*

*Attesting Officer*

JAMES E. ROGAN
*Director of the United States Patent and Trademark Office*